US011156089B2

(12) United States Patent
Koda

(10) Patent No.: US 11,156,089 B2
(45) Date of Patent: Oct. 26, 2021

(54) STEAM TURBINE

(71) Applicant: MITSUBISHI HEAVY INDUSTRIES COMPRESSOR CORPORATION, Tokyo (JP)

(72) Inventor: Takuro Koda, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 768 days.

(21) Appl. No.: 15/551,625

(22) PCT Filed: Feb. 23, 2015

(86) PCT No.: PCT/JP2015/055072
§ 371 (c)(1),
(2) Date: Aug. 17, 2017

(87) PCT Pub. No.: WO2016/135832
PCT Pub. Date: Sep. 1, 2016

(65) Prior Publication Data

US 2018/0038230 A1 Feb. 8, 2018

(51) Int. Cl.
*F01D 1/16* (2006.01)
*F01D 5/14* (2006.01)
*F01D 17/16* (2006.01)

(52) U.S. Cl.
CPC ..... *F01D 1/16* (2013.01); *F01D 5/142* (2013.01); *F01D 17/162* (2013.01); (Continued)

(58) Field of Classification Search
CPC ..... F01D 1/16; F01D 5/142
See application file for complete search history.

(56) References Cited

U.S. PATENT DOCUMENTS 3,291,447 A * 12/1966 Brandon ..... F01D 11/02 415/111
4,403,915 A 9/1983 Teufelberger
(Continued)

FOREIGN PATENT DOCUMENTS

CH 108142 A 12/1924
EP 1260674 A1 11/2002
(Continued)

OTHER PUBLICATIONS

International Search Report and Written Opinion of the International Searching Authority (Forms PCT/ISA/237 and PCT/ISA/210), dated May 26, 2015, for International Application No. PCT/JP2015/055072, with an English translation.

*Primary Examiner* — Michael L Sehn
(74) *Attorney, Agent, or Firm* — Birch, Stewart, Kolasch & Birch, LLP.

(57) ABSTRACT

Provided is a steam turbine in which, among a plurality of stages thereof, a stage that is disposed furthest upstream is a speed-adjusting stage, at least one stage that is disposed downstream of the speed-adjusting stage is a medium-pressure stage, and at least one stage that is disposed downstream of the medium-pressure stage is a low-pressure stage. The speed-adjusting stage is an impulse stage. The medium-pressure stage is a medium reaction degree impulse stage in which the degree of reaction is a medium degree of reaction of 10-40%. The low-pressure stage is a reaction stage having a higher degree of reaction than the medium-pressure stage.

8 Claims, 6 Drawing Sheets

(52) U.S. Cl.
CPC ..... *F05B 2240/11* (2013.01); *F05B 2240/12* (2013.01); *F05B 2240/30* (2013.01); *F05D 2220/31* (2013.01)

(56) References Cited

U.S. PATENT DOCUMENTS

| | | | | |
|---|---|---|---|---|
| 5,152,661 | A * | 10/1992 | Sheets | F01D 5/145 415/84 |
| 5,203,676 | A | 4/1993 | Ferleger et al. | |
| 5,328,326 | A | 7/1994 | Gros et al. | |
| 6,332,754 | B1 | 12/2001 | Matsuda et al. | |
| 6,345,952 | B1 * | 2/2002 | Oeynhausen | F01D 1/16 415/100 |
| 2002/0098082 | A1 | 7/2002 | Ito et al. | |

FOREIGN PATENT DOCUMENTS

| | | | |
|---|---|---|---|
| JP | 58-104302 | U | 7/1983 |
| JP | 2000-104501 | A | 4/2000 |
| JP | 2000-291403 | A | 10/2000 |
| JP | 2001-510525 | A | 7/2001 |
| JP | 3238267 | B2 | 12/2001 |
| JP | 2002-221004 | A | 8/2002 |
| JP | 2002-339703 | A | 11/2002 |

* cited by examiner

FIG. 5

| BLADE TYPE | IMPULSE STAGE | MEDIUM REACTION DEGREE IMPULSE STAGE | REACTION STAGE |
|---|---|---|---|
| DEGREE OF REACTION (%) | ~10 | 10~40 | 40~ |
| OPTIMUM SPEED RATIO (-) | 2.2~1.8 | 1.9~1.5 | 1.5~1.2 |
| ROTOR BLADE DEFLECTION ANGLE (deg) | 140~120 | 120~100 | 110~70 |
| STATOR BLADE DEFLECTION ANGLE (deg) | 80~70 | 80~60 | 70~55 |
| ROTOR BLADE Lp/Lc (-) | ~0.7 | 0.7~0.8 | 0.7~0.9 |
| STATOR BLADE Lp/Lc (-) | 0.3~0.6 | 0.5~0.8 | 0.6~0.9 |

STEAM TURBINE

TECHNICAL FIELD

The present invention relates to a steam turbine which is driven by a steam.

BACKGROUND ART

The steam turbine includes, a rotor which rotates about an axis line and a casing which covers the rotor. The rotor includes a rotor shaft which extends in an axial direction about the axis line and a plurality of rotor blade rows which are fixed to an outer periphery of the rotor shaft and are arranged in the axial direction. Moreover, the steam turbine includes a stator blade row which is fixed to an inner periphery of the casing and is disposed on an upstream side for each of the plurality of rotor blade rows. In general, a set of the rotor blade row and the stator blade row adjacent to the upstream side of the rotor blade row is referred to as a stage.

In a steam turbine disclosed in the following PTL 1, a speed-adjusting stage which is a stage on the most upstream side is an impulse stage, and ail stages on the downstream side of the speed-adjusting stage are reaction stages. A rotor blade row of each reaction stage is fixed to an outer periphery of a drum-type rotor shaft. This drum-type rotor shaft refers to a rotor shaft having a cylindrical shape whose entirety is long in an axial direction. The reaction stage is a stage which increases a flow velocity of steam and applies a rotating force to the rotor blade row by reaction of this steam while decreasing a steam pressure in the rotor blade row configuring the reaction stage.

CITATION LIST

Patent Literature

[PTL 1] Japanese Patent No. 3238267

SUMMARY OF INVENTION

Technical Problem

Compared to a case where an impulse stage is used as a stage of a steam turbine, if the reaction stage is used as the stage of the steam turbine, it is possible to basically increase blade performance. However, compared to the impulse stage, since a pressure difference between the upstream side and the downstream side of the rotor blade row configuring the reaction stage is large in the reaction stage, a portion of steam existing on the upstream, side of the rotor blade row does not pass through the rotor blade raw and a leakage amount of the steam increases.

In the steam turbine disclosed in PTL 1, as described above, all stages on the downstream side of the impulse stage are reaction stages while the speed-adjusting stags on the most upstream side is impulse stage. If the steam leakage increases at an upstream reaction stage among the stages configuring the reaction stage, it is impossible to effectively use energy which is still included in a high-pressure steam immediately after the steam passes through the speed-adjusting stage. Accordingly, in the steam carbine disclosed in PTL 1, it cannot be said that turbine efficiency is sufficiently high.

Therefore, an object of the present invention is to provide a steam turbine capable of further increasing turbine efficiency.

Solution to Problem

In order to achieve the object, according to an aspect of the present invention there is provided a steam turbine, including: a rotor shaft which rotates about an axis line; a plurality of rotor blade rows which are fixed to an outer periphery of the rotor shaft and are arranged in an axial direction in which the axis line extends; and a stator blade row which is adjacent to an upstream side in the axial direction of the rotor blade row for each of the plurality of rotor blade rows. Among a plurality of stages configured of a set of the rotor blade row and the stator blade row disposed to be adjacent to the upstream side of the rotor blade row, a stage disposed on the most upstream, side is a speed-adjusting stage, at least one stage disposed on a downstream side of the speed-adjusting stage is a medium-pressure stage, and at least one stage disposed on a downstream side of the medium-pressure stage is a low-pressure stage. The speed-adjusting stage is an impulse stage, the medium-pressure stage is a medium reaction degree impulse stage in which a degree of reaction is a medium degree of reaction of 10 to 40%, and the low-pressure stage is a reaction stage having a degree of reaction which is higher than the degree of reaction of the medium-pressure stage.

Blade performance of blades configuring a stage basically increases as the degree of reaction of the stage increases. However, in the stage having a great degree of reaction, since a pressure difference between the upstream side and the downstream side of the rotor blade row configuring the stage increases, a portion of steam existing on the upstream side of the rotor blade row does not pass through the rotor blade row, and a leakage amount of the steam increases.

In a case where steam leakage increases at an upstream stage among a plurality of stages having great degrees of reaction, it is impossible to effectively use energy which is still included in a high-pressure steam immediately after the steam, passes through the speed-adjusting stage, and as a result, it is not possible to increase the turbine efficiency.

In the steam turbine, the speed-adjusting stage is set to the impulse stage and the medium-pressure stage on the downstream side of the speed-adjusting stage is set to the medium reaction degree impulse stage. In addition, the degree of reaction of the medium-pressure stage is set to be lower than the degree of reaction of the low-pressure stage on the downstream side of the medium-pressure stage while the degree of the reaction of the medium-pressure stage is set to be greater than the degree of reaction of the speed-adjusting stage.

Accordingly, in the steam turbine, in the present embodiment, the pressure difference between the upstream side and the downs cream side at the stage configuring the medium-pressure stage positioned on the downstream side of the speed-adjusting stage decreases, and it is possible to decrease a leakage amount of steam at the stage configuring the medium-pressure stage. Therefore, in the steam turbine, the blade performance of the blades configuring the medium-pressure stage is higher than the blade performance of the blades configuring the speed-adjusting stage, it is possible to effectively use energy included in a high-pressure steam at the medium-pressure stage, and it is possible to increase turbine efficiency.

Here, in the steam turbine, the degree of reaction of the medium reaction degree impulse stage may be 25% to 35%.

In addition, any one of the above-described steam turbines, the medium-pressure stage is configured to include a plurality of stages, and degrees of reaction of the plurality of stages configuring the medium-pressure stage gradually increase from an upstream stage toward a downstream stage.

In the steam turbine, since the degree of reaction of the stage on the upstream side, through which steam having a higher pressure passes, among the medium-pressure stages decreases, it is possible to decrease leakage of the steam having a higher pressure.

In addition, in any one of the above-described steam turbines, the rotor shaft may include a plurality of partition portions which spread in a radial direction based on the axis line and are arranged in the axial direction with a gap therebetween, the rotor blade row of the medium-pressure stage may be fixed to an outer peripheral portion of any one partition portion of the plurality of partition portions, and a balance hole penetrating in the axial direction may be formed in a medium-pressure stage partition portion which is the partition portion to which the rotor blade row of the medium-pressure stage is fixed.

In the steam turbine, since a disk-shaped rotor shaft is adopted as the rotor shaft, compared to a case where a drum-type rotor shaft is adopted as the rotor shaft, it is possible to decrease steam leakage.

However, in a case where the disk-shaped rotor shaft is adopted in a steam turbine which includes a stage having a great degree of reaction, a thrust force applied to the rotor shaft increases, and the size of the thrust bearing increases. This is because in a case where the stage having a great degree of reaction is provided, the pressure difference between the upstream side and the downstream side of the partition portion to which the rotor blade row of this stage is fixed increases. Accordingly, in the steam turbine, even when the disk-shaped rotor shaft in which a leakage amount of steam decreases is adopted as the rotor shaft, in order to decrease the thrust force applied to the rotor shaft, the balance hole is formed in the medium-pressure stage partition portion.

In the steam turbine in which the rotor shaft has the plurality of partition portions, the stator blade row may include a plurality of stator blades which are arranged in a circumferential direction about the axis line and an inner ring which is disposed on the inside in a radial direction of the plurality of stator blades with respect to the axis line and to which the plurality of stator blade rows are fixed, the inner ring of the stator blade row configuring the medium-pressure stage may face the medium-pressure stage partition portion with a gap therebetween in the axial direction, and the steam turbine may further include a seal which is fixed to the inner ring of the stator blade row configuring the medium-pressure stage and seals a portion between the inner ring and the medium-pressure stage partition portion on a portion positioned further outside in the radial direction with respect to the axis line than the balance hole. In addition, a plurality of seals may be provided. In this case, the plurality of seals may form a row.

In the steam turbine, it is possible to further decrease steam leakage in the medium-pressure stage.

In the steam turbine including the seal, in the medium-pressure stage partition portion, an intermediate peripheral surface may be formed in the radial direction with respect to the axis line further outside in the radial direction than the balance hole on the inner ring side of the medium-pressure stage partition portion, and the seal may include a radial fin having a tip portion which extends in the radial direction and faces the intermediate peripheral surface of the medium-pressure stage partition portion.

In a case where the seal which seals a portion between the inner ring of the stator blade row configuring the medium-pressure stage and the medium-pressure stage partition portion of the rotor shaft is an axial fin, due to thermal elongation (thermal expansion) of the rotor shaft in the axial direction according to the inflow of the steam with respect to the steam turbine, a gap between the tip of the axial fin and the facing surface increases compared to the time of assembly. Accordingly, in the case where the seal is the axial fin, a leakage amount of the steam due to variation in the inflow amount of the steam with respect to the steam turbine increases. Since the seal has a radial fin in this steam turbine, even when the thermal elongation of the rotor shaft in the axial direction is generated according to variation of the inflow amount of the steam with respect to the steam turbine, variation of the gap between the tip of the radial fin and the facing surfaces decreases. Accordingly, in the steam turbine, it is possible to significantly decrease the steam leakage at the medium-pressure stage which is the medium reaction degree impulse stage.

In any one of the above-described steam turbines, an optimum speed ratio of the medium-pressure stage may be smaller than an optimum speed ratio of the speed-adjusting stage and may be greater than an optimum speed ratio of the low-pressure stage. In addition, here, the speed ratio means a value obtained by dividing an absolute speed of steam by a peripheral speed. If the degree of reaction of the medium-pressure stage is a medium level with respect to the degrees of reaction of other stages, the optimum speed ratio of the medium-pressure stage basically becomes a medium level with respect to the optimum speed ratios of other stages.

In addition, in any one of the above-described, steam turbines, the optimum speed ratio of the medium-pressure stage may be less than 1.9 and equal to or more than 1.5.

Moreover, in any one of the above-described steam turbines, deflection angles of a plurality of rotor blades configuring the rotor blade row of the medium-pressure stage may be smaller than deflection angles of a plurality of rotor blades configuring the rotor blade row of the speed-adjusting stage and may be greater than deflection angles of a plurality of rotor blades configuring the rotor blade row of the low-pressure stage. Moreover, blade performance increases as the deflection angle decreases. In addition, if the degree of reaction of the medium-pressure stage is a medium level with respect to the degrees of reaction of other stages, the deflection angle of the rotor blade configuring the medium-pressure stage basically becomes a medium level with respect to the deflection angles of the rotor blades configuring other stages.

In addition, in any one of the above-described steam turbines, the deflection angles of the plurality of rotor blades configuring the rotor blade row of the medium-pressure stage may be less than 120° and equal to or more than 100°.

Moreover, in any one of the above-described steam turbines, deflection angles of a plurality of stator blades configuring the stator blade row of the medium-pressure stage may be smaller than deflection angles of a plurality of stator blades configuring the stator blade row of the speed-adjusting stage and may be greater than deflection angles of a plurality of stator blades configuring the stator blade row of the low-pressure stage. Moreover, blade performance increase as the deflection angle decreases. In addition, if the degree of reaction of the medium-pressure stage is a medium level with respect to the degrees of reaction of other stages, the deflection angle of the stator blade configuring the medium-pressure stage basically becomes a medium level with respect to the deflection angles of the stator blades configuring other stages.

Moreover, in any one of the above-described steam turbines, the deflection angles of the plurality of stator blades configuring the stator blade row of the medium-pressure stage may be less than 80° and equal to or more than 60°.

In addition, in any one of the above-described steam turbines, a ratio of a pitch with respect to a cord length of the plurality of rotor blades configuring the rotor blade row of the medium-pressure stage may be greater than a ratio of a pitch with respect to a cord length or the plurality of rotor blades configuring the rotor blade row of the speed-adjusting stage and may be smaller than a ratio of a pitch with respect to a cord length of the plurality of rotor blades configuring the rotor blade row of the low-pressure stage. Moreover, blade performance increase as the ratio of the pitch with respect to the cord length increases. In addition, if the degree of reaction of the medium-pressure stage is a medium level with respect to the degrees of reaction of other stages, the same ratio of the rotor blade configuring the medium-pressure stage basically becomes a medium level with respect to the same ratios of the rotor blades configuring other stages.

Moreover, in any one of the above-described steam turbines, the ratio of a pitch with respect, to the cord length of the plurality of rotor blades configuring the rotor blade row of the medium-pressure stage may be equal to or more than 0.7 and less than 0.8.

In addition, in any one of the above-described steam turbines, a ratio of a pitch with respect to a cord length of the plurality of stator blades configuring the stator blade row of the medium-pressure stage may be greater than a ratio of a pinch with respect, to a cord length or the plurality of stator blades configuring the stator blade row of the speed-adjusting stage and may be smaller than a ratio of a pitch with respect to a cord length of the plurality of stator blades configuring the stator blade row of the low-pressure stage. Moreover, blade performance increases as the ratio of the pitch with respect to the cord length increases. In addition, if the degree of reaction of the medium-pressure stage is a medium level with respect to the degrees of reaction of other stages, the same ratio of the stator blade configuring the medium-pressure stage basically becomes a medium level with respect to the same ratios of the stator blades configuring other stages.

Moreover, in any one of the above-described steam turbines, the ratio of the pitch with respect to the cord length of the plurality of stator blades configuring the stator blade row of the medium-pressure stage may foe equal to of more than 0.5 and less than 0.8.

In addition, in any one of the above-described steam turbines, the plurality of rotor blades configuring the rotor blade row of the medium-pressure stage may be parallel blades.

Advantageous Effects of Invention

In an aspect of the present invention, it is possible to increase turbine efficiency of the steam turbine.

BRIEF DESCRIPTION OF DRAWINGS

FIG. 5 is an explanatory view showing values of various parameters of the steam turbine in the embodiment according to the present invention.

DESCRIPTION OF EMBODIMENTS

Hereinafter, an embodiment of a steam turbine according to the present invention will be described with reference to the drawings.

Figure 1:
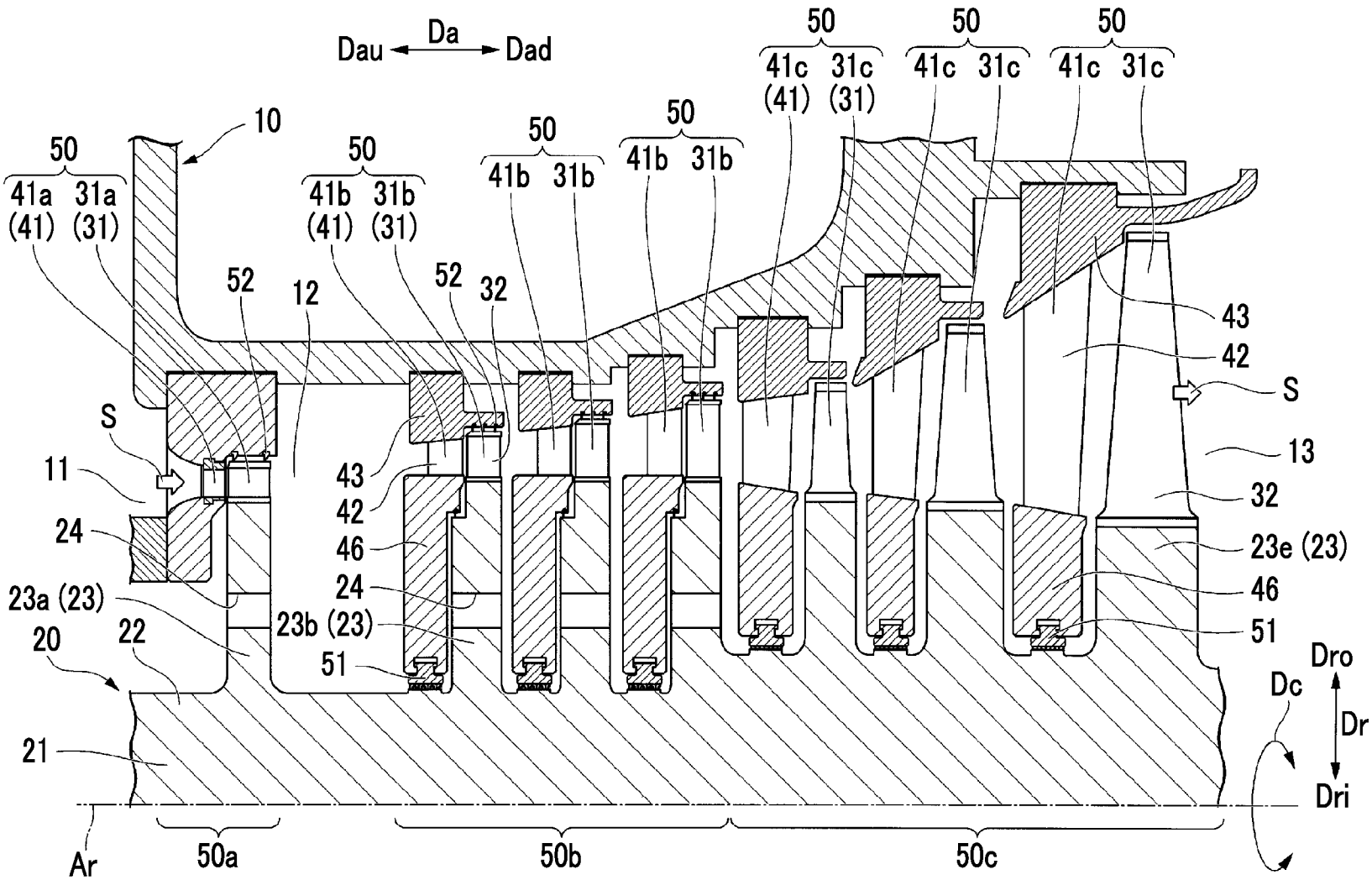
FIG. 1 is a sectional view of a steam turbine according to an embodiment of the present invention.

As shown in FIG. 1, a steam turbine of the present embodiment includes a rotor 20 which rotates about an axis line A4 and a casing 10 which rotatably covers the rotor 20. Moreover, for convenience of the following description, a direction in which the axis line Ar extends is referred to as an axial direction Da, one side in the axial direction Da is referred to as an upstream side Dau, and the other side in the axial direction Da is referred to as a downstream side Dad. In addition, a radial direction based on the axis line Ar is simply referred to as a radial direction Dr, a side close to the axis line Ar in the radial direction Dr is referred to an inside in a radial direction Dri, and a side opposite to the inside in the radial direction Dri in the radial direction Dr is referred to as an outside in a radial direction Dro. In addition, a circumferential direction about the axis line Ar is simply referred to as a circumferential direction Dc.

The rotor 20 includes a rotor shaft 21 which extends in the axial direction Da about the axis line Ar and a plurality of rotor blade rows 31 which are attached to the outer periphery of the rotor shaft 21. The plurality of rotor blade rows 31 are arranged in the axial direction Da. In the case of the present embodiment, the number of the rotor blade rows 31 is seven. Accordingly, in the case of the present embodiment, the rotor blade rows 31 include a first stage rotor blade row 31 to a seventh stage rotor blade row 31. One rotor blade row 31 includes a plurality of rotor blades 32 (refer to FIG. 2) which are arranged in the circumferential direction Dc.

Figure 3:
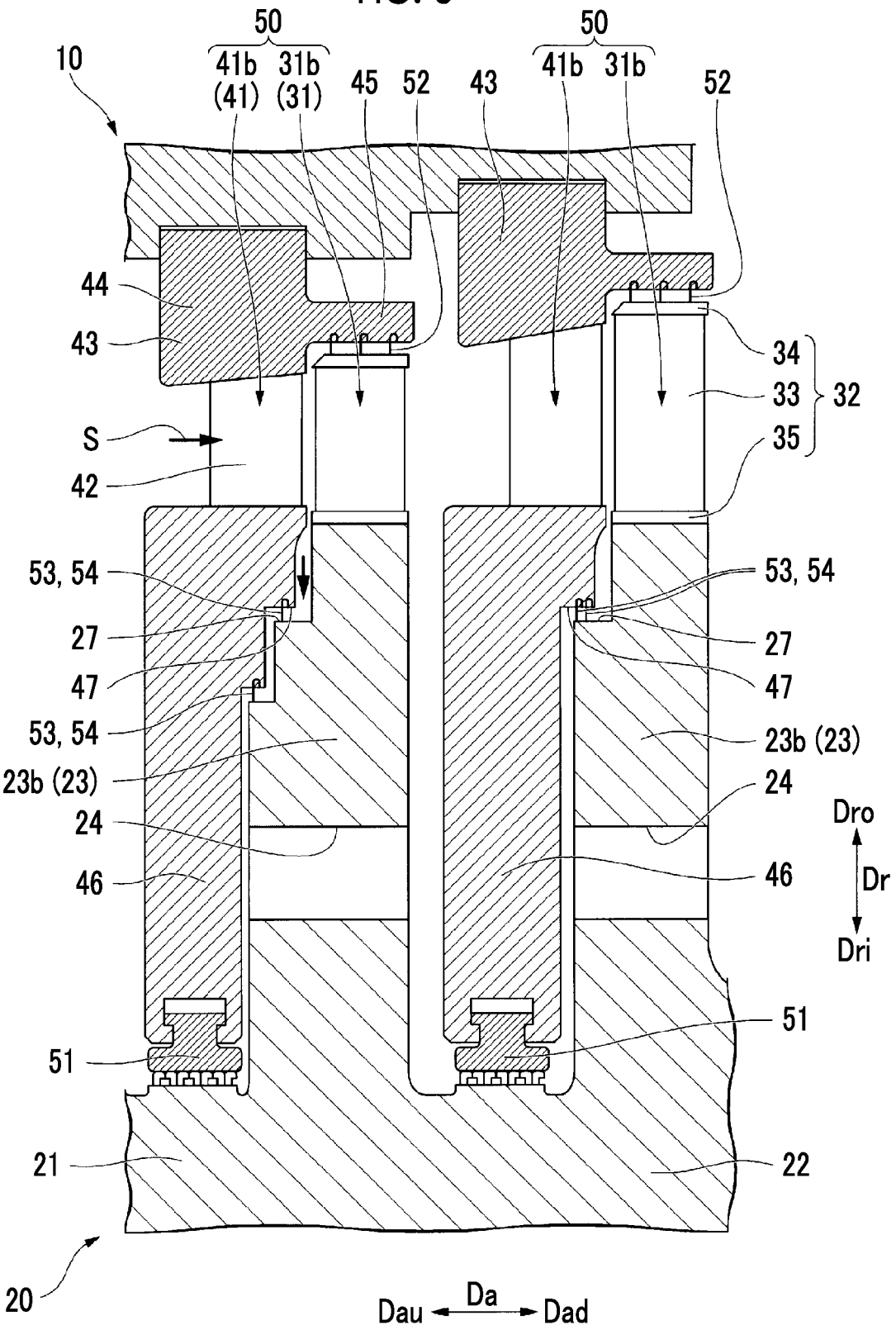
FIG. 3 is a sectional view of the steam turbine around a medium-pressure stage in the embodiment of the present invention.

As shown in FIG. 3, the rotor blade 32 includes a blade body 33 which extends in the radial direction Dr, a shroud 34 which is provided on the outside in the radial direction Dro of the blade body 33, a platform 35 which is provided on the inside in the radial direction Dri of the blade body 33, and a blade root (not shown) which is provided on the inside in the radial direction Dri of the platform 35. A steam main flow path, through which steam S flows, is formed between the shroud 34 and the platform 35 by the rotor blades 32.

The rotor shaft 21 is formed in an approximately columnar shape about the axis line Ar, and includes an axial core portion 22 which extends in the axial direction Da and a plurality of partition portions 23 which spread in a radial direction from the axial core portion 22 and are arranged in the axial direction Da with gaps therebetween. The partition portion 23 is provided for each of the plurality of rotor blade rows 31. The blade roots of the plurality of rotor blades 32 configuring the rotor blade rob 31 are embedded in the outer peripheral portion of the partition portion 23 in the rotor shaft 21. Accordingly, the rotor blades 32 are fixed to the rotor shaft 21. Therefore, the rotor shaft 21 of the present embodiment is a disk-shaped rotor shaft.

Figure 2:
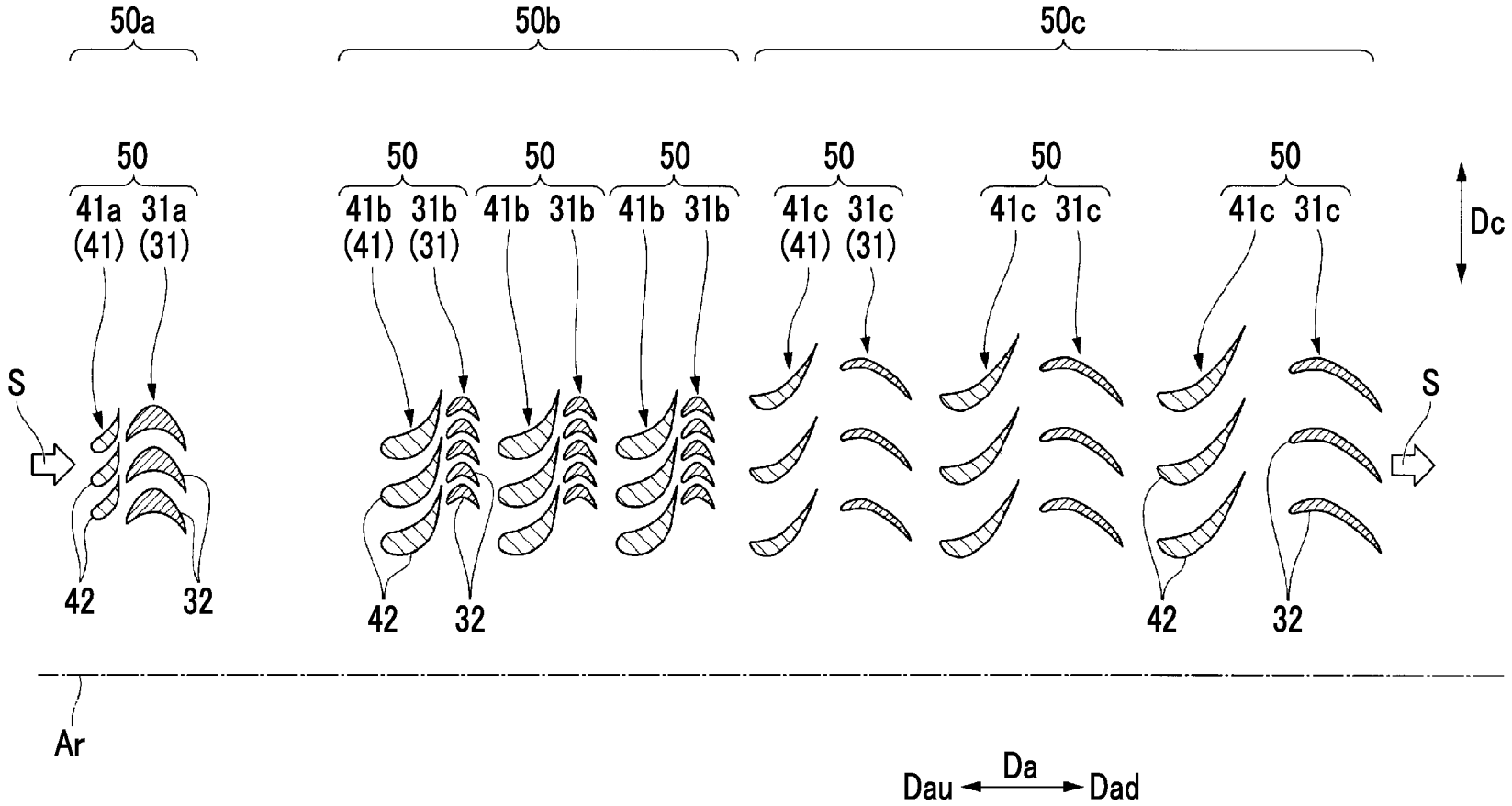
FIG. 2 is an explanatory view showing dispositions of blade rows and dispositions of a plurality of blades configuring the blade rows in the steam turbine according to the embodiment of the present invention.

As shown in FIGS. 1 and 2, the steam turbine further includes a plurality of stator blade rows 41 which are arranged in the axial direction Da. In the case of the present embodiment, the number of the stator blade rows 41 is seven which is the same as the number of the rotor blade rows 31. Accordingly, in the case of the present embodiment, the stator blade rows 41 include a first stator blade row 41 to a seventh stage stator blade row 41. All of the plurality of the stator blade rows 41 are disposed on the upstream side Dan of some rotor blade rows 31.

As shown in FIGS. 1 to 3, the stator blade row 41 includes a plurality of stator blades 42 (refer to FIG. 2) which are arranged in the circumferential direction Dc, an annular outer ring 43 which is provided on the outside in the radial direction Dro of the plurality of stator blades 42, and an annular inner ring 46 which is provided on the inside in the radial direction Dri of the plurality of stator blades 42. That is, the plurality of stator blades 42 are disposed between the outer ring 43 and the inner ring 46 and are fixed to the rings 43 and 46. An annular space between the outer ring 43 and the inner ring 46 forms the steam main flow path through which the steam S flows. The outer ring 43 includes a ring main body portion 44 to which the plurality of stator blades 42 are fixed and a ring protrusion portion 45 which protrudes from the ring main body portion 44 toward the downstream side Dad. The ring protrusion portion 45 faces the rotor blade row 31 adjacent to the downstream side Dad of the stator blade row 41 with a gap in the radial direction Dr.

As shown in FIG. 1, in the casing 10, a nozzle chamber 11 into which the steam S flows from the outside, a steam main flow path chamber 12 through which the steam S from the nozzle chamber 11 flows, and an exhaust chamber 13 to which the steam S flowing from the steam main flow path chamber 12 is discharged are formed. The first stator blade row 41 on the most upstream side Dau among the plurality of stator blade rows 41 is disposed between the nozzle chamber 11 and the steam main flow path chamber 12. That is, the nozzle chamber 11 and the steam main flow path chamber 12 are partitioned by the first stage stator blade row 41 in the casing 10. All stator blade rows 41 except for the first stage stator blade row 41 among the plurality of stator blade rows 41 and all of the plurality of rotor blade rows 31 are disposed in the steam main flow path chamber 12.

The plurality of stator blade rows 41 are fixed to the inner periphery of the casing 10.

A set of the rotor blade row 31 and the stator blade row 41 adjacent to the upstream side Dau of the rotor blade row 31 forms one stage 50. Since the stator blade row 41 is provided with respect to each of the seven rotor blade rows 31, the steam turbine of the present embodiment includes seven stages 50.

As shown in FIGS. 1 and 2, in the steam turbine of the present embodiment, the first stage 50 on the most upstream side among the plurality of stages 50 forms a speed-adjusting stage 50*a* which adjusts a flow rate of the steam S fed to the stages 50 on the downstream side Dad of the first stage 50 so as to adjust a rotation speed of the rotor 20. In the steam turbine of the present embodiment, the second stage 50, the third stage 50, and the fourth stage 50 form a medium-pressure stage 50*b*. Moreover, in the steam turbine of the present embodiment, the fifth stage 50, the sixth stage 50, and the seventh stage 50 form a low-pressure stage 50*c*. Accordingly, hereinafter, the first stage stator blade row 41 configuring a portion of the speed-adjusting stage 50*a* is referred to a speed-adjusting stage stator blade row 41*a*, and the first stage rotor blade row 31 configuring the other portions of the speed-adjusting stage 50*a* is referred to a speed-adjusting stage rotor blade row 31*a*. In addition, the second stage stator blade row 41 to the fourth stage stator blade row 41 configuring a portion of the medium-pressure stage 50*b* are referred to as medium-pressure stage stator blade row 41*b*, and the second stage rotor blade row 31 to the fourth stage rotor blade row 31 configuring the other portions of the medium-pressure stage 50*b* are referred to as medium-pressure stage rotor blade rows 31*b*. In addition, the fifth stage stator blade row 41 to the seventh stage stator blade row 41 configuring a portion of the low-pressure stage 50*c* is referred to as low-pressure stage stator blade rows 41*c*, and the fifth stage rotor blade row 31 to the seventh stage rotor blade row 31 configuring the other portions of the low-pressure stage 50*c* are referred to low-pressure stage rotor blade rows 31*c*. In addition, the partition portion 23 of the rotor shaft 21 to which the speed-adjusting stage rotor blade row 31*a* is fixed is referred to as a speed-adjusting stage partition portion 23*a*, the partition portion 23 of the rotor shaft 21 to which the medium-pressure stage rotor blade row 31*b* is fixed is referred to as a medium-pressure stage partition portion 23*b*, and the partition portion 23 of the rotor shaft 21 to which the low-pressure stage rotor blade row 31*c* is fixed is referred to as a low-pressure stage partition portion 23*c*.

All of the plurality of rotor blades 32 configuring the speed-adjusting stage rotor blade row 31*a* and the medium-pressure stage rotor blade row 31*b* are parallel blades. Meanwhile, all of the plurality of rotor blades 32 configuring the low-pressure stage rotor blade row 31*c* are twisted blades. The parallel blade is a blade in which a direction of a chord is not changed even when a position is changed in the radial direction Dr, that is, a position is changed in a blade height direction. Moreover, the twisted blade is a blade which the direction of the chord is gradually changed according to the positional change in the radial direction Dr.

As shown in FIGS. 1 and 3, an inner seal 51 which seals a portion between the inner ring 46 and the axial core portion 22 of the rotating rotor shaft 21 is provided on the inside in the radial direction Dri of the inner ring 46 of each of the medium-pressure stage stator blade row 41*b* and the low-pressure stage stator blade row 41*c*.

An outer seal 52 which seals a portion between the ring protrusion portion 45 and the rotor blade row 31 disposed on the inside in the radial direction Dri of the ring protrusion portion 45 is provided on the ring protrusion portion 45 of the outer ring 43 of each of the speed-adjusting stage stator blade row 41*a* and the medium-pressure stage stator blade row 41*b*.

A balance hole 24 which penetrates in the axial direction Da is formed in the speed-adjusting stage partition portion 23*a* and the medium-pressure stage partition portion 23*b*. Moreover, the balance hole may be also formed in the low-pressure stage partition portion 23*c*.

As shown in FIG. 3, an intermediate seal 53 which seals the inner ring 46 and the medium-pressure stage partition portion 23*b* adjacent to the downstream side Dad of the inner ring 46 is provided in the inner ring 46 of the medium-pressure stage stator blade row 41*b*. In the medium-pressure stage partition portion 23*b*, an intermediate peripheral surface 27 facing the outside in the radial direction Dro is formed at a position close to the outside in the radial direction Dro than the balance hole 24 on the upstream side Dau of the medium-pressure stage partition portion 23*b*. Meanwhile, an intermediate peripheral surface 47 facing the intermediate peripheral surface 27 of the medium-pressure stage partition portion 23*b* in the radial direction Dr is formed on the inner ring 46 of the medium-pressure stage stator blade row 41*b*. The intermediate seal 53 is provided at the position of the intermediate peripheral surface 47 in the inner ring 46 of the medium-pressure stage stator blade row 41*b*. The intermediate seal 53 includes a radial fin 54 which extends to the inside in the radial direction Dri and faces the intermediate peripheral surface 27 of the medium-pressure stage partition portion 23*b*.

Figure 4:
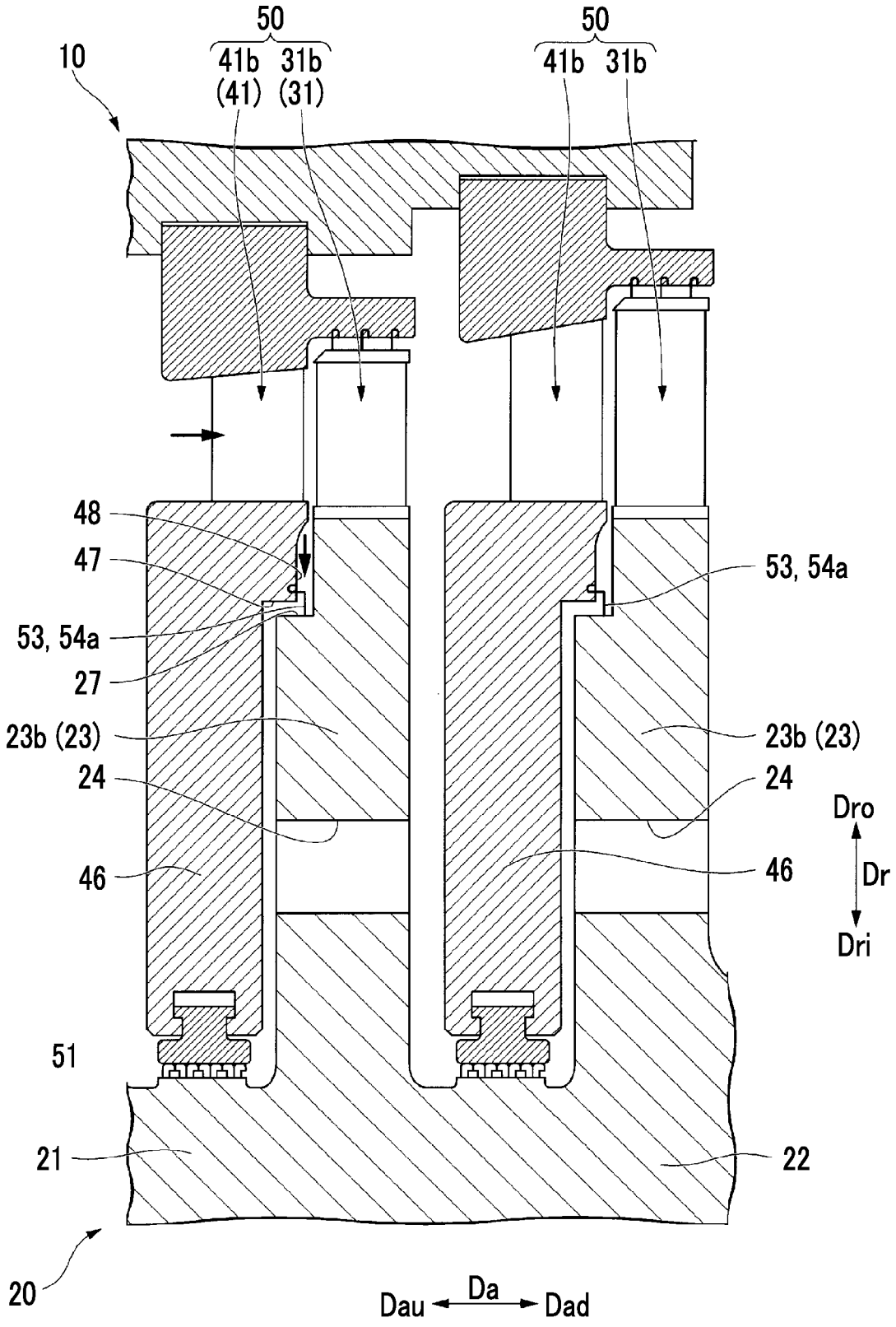
FIG. 4 is a sectional view of the steam turbine around a medium-pressure stage in a modification example of the embodiment of the present invention.

In addition, the radial fin 54 may be provided at positions except for the position of the intermediate peripheral surface 47 in the inner ring 46 of the medium-pressure stage stator blade row 41*b*. For example, as shown in FIG. 4, the radial fin 54 may be provided at a position of a downstream end surface 48 facing the downstream side Dad so as to be closer to the outside in the radial direction Dro than the intermediate peripheral surface 47 of the inner ring 46 of the medium-pressure stage stator blade row 41*b*. In this case, after the radial fin 54*a* extends to the downstream side Dad from the downstream end surface 48 of the inner ring 46, the radial fin 54*a* extends to the inside in the radial direction Dri. The tip portion of the radial fin 54*a* which extends to the inside in the radial direction Dri faces the intermediate peripheral surface 27 of the medium-pressure stage partition portion 23*b*.

The speed-adjusting stage 50*a* of the present embodiment is an impulse stage, the medium-pressure stage 50*b* is a medium reaction degree impulse stage, and the low-pressure stage 50*c* is a reaction stage, Here, a degree of reaction will be described.

The degree of reaction is a ratio of a heat drop in the rotor blade of the stage with respect to a heat drop in the stage. In other words, the degree of reaction is a proportion of the change amount of static enthalpy at the rotor blade in the change amount of the total enthalpy per stage. Alternatively, the degree of reaction is a ratio of a pressure difference in the rotor blade of the stage with respect to a pressure difference at the stage.

In a case where the degree of reaction is sere, the pressure change in the rotor blade does not occur. Meanwhile, in a case where the degree of reaction is not zero, a flow velocity of the steam in the rotor blade increases while the pressure in the rotor blade decreases. Accordingly, in a case where the degree of reaction is not zero, steam is expanded while passing through the rotor blade, and a reaction force generated by this expansion is applied to the rotor blade. In a case where the degree of reaction is zero, only impulse action of the steam is the work of steam to the rotor blade. However, in a case where the degree of reaction, is not zero, in addition to the impulse action of the steam, reaction action becomes the work of steam to the rotor blade. Accordingly, the blade performance basically increases as the degree of reaction increases.

There are various definitions as definitions of the impulse stage and the reaction stage. For example, in a definition, a stage in which the degree of reaction is zero is set as the impulse stage, and a stage in which the degree of reaction is not zero is set as the reaction stage. However, as the definitions of the impulse stage and the reaction stage, there are other definitions. In the present application, a stage in which the degree of reaction is less than 10% is set to the impulse stage, a stage in which the degree of reaction is equal to or more than 10% and less than 40% is set to the medium reaction degree impulse stage, and a stage in which the degree of reaction is equal to or more than 40% is set to the reaction stage.

As described above, the blade performance basically increases as the degree of reaction increases. Accordingly, in the steam turbine disclosed in PTL 1 described in Background Art, all stages except for the speed-adjusting stage are set to reaction stages. However, compared to she impulse stage, since the pressure difference between the upstream side and the downstream side of the rotor blade row configuring the reaction stage is larger in the reaction stage, a portion of the steam existing on the upstream side of the rotor blade row does not pass through the rotor blade row and a leakage amount of the steam increases.

In a case where the steam leakage increases at an upstream reaction stage among the stages configuring the reaction stage, it is impossible to effectively use energy which is still included in a high-pressure steam immediately after the steam passes through the speed-adjusting stage, and as a result, it is not possible to increase the turbine efficiency.

Accordingly, in the present embodiment, the medium-pressure stage 50*b* on the downstream side Dad of the speed-adjusting stage 50*a* (impulse stage) is set to the medium reaction degree impulse stage, and the degree of reaction of the medium-pressure stage 50*b* is greater than the degree of reaction of the speed-adjusting stage 50*a* and is smaller than the degree of reaction of the low-pressure stage 50*c* (reaction stage) on the downstream side Dad of the medium-pressure stage 50*b*.

As a result, in the present embodiment, the pressure difference between the upstream side Dau and the downstream side Dad at each stage 50 configuring the medium-pressure stage 50*b* on the downstream side Dad of the speed-adjusting stage 50*a* decreases, and it is possible to decrease a leakage amount of high-pressure steam at each stage 50 configuring the medium-pressure stage 50*b*. Accordingly, in the present embodiment, the blade performance of the blades configuring the medium-pressure stage 50*b* is higher than the blade performance of the blades configuring the speed-adjusting stage 50*a*, it is possible to effectively use energy included in the high-pressure steam in the medium-pressure stage 50*b*, and it is possible to increase turbine efficiency.

Here, more preferably, the degree of reaction of the medium-pressure stage 50*b* which is the medium reaction degree impulse stage is equal to or more than 25% and equal to or less than 35%. Moreover, in the present embodiment, for example, the degrees of reaction of the second stage 50, the third stage 50, and the fourth stage 50 configuring the medium-pressure stage 50*b* are as follows.

The degree of reaction of the second stage 50 is 25%, the degree of reaction of the third stage 50 is 30%, and the degree of reaction of the fourth stage 50 is 35%. In this way, in the present embodiment, the degrees of the reaction of the plurality of stages 50 configuring the medium-pressure stage 50*b* gradually increase from the stage 50 on the upstream side Dau toward the stage 50 on the downstream side Dad. Accordingly, in the present embodiment, since the degree of reaction of the stage 50 on the upstream side Dau, through which steam having a higher pressure passes, among the medium-pressure stages 50*b* decreases, leakage of steam having a high pressure decreases. However, in the present embodiment, the degrees of the reaction of the plurality of stages 50 configuring the medium-pressure stage 50*b* may not be gradually increased from the stage 50 on the upstream side Dau toward the stage 50 on the downstream side Dad.

As described above, in the present embodiment, in order to set the speed-adjusting stage 50*a* to the impulse stage, set the medium-pressure stage 50*b* to the medium reaction degree impulse stage, set the low-pressure stage 50*c* to the reaction stage, and furthermore, in order to further increase the turbine efficiency, values of FIG. 5 are adopted as various parameters of each stage 50.

Figure 6:
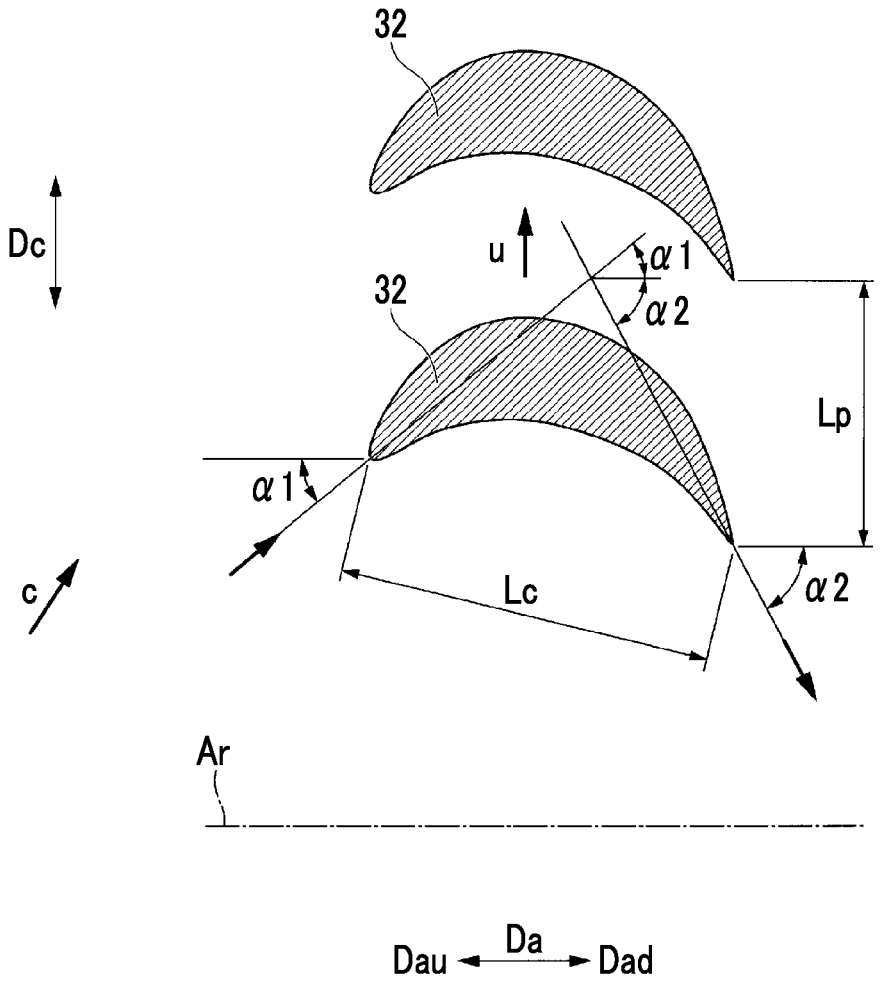
FIG. 6 is an explanatory view for explaining the various parameters in FIG. 5.

In the present embodiment, an optimum speed ratio of the impulse stage (speed-adjusting stage 50*a*) is less than 2.2 and equal to or more than 1.8, an optimum speed ratio of the medium reaction degree impulse stage (medium-pressure stage 50*b*) is less than 1.9 and equal to or more than 1.5, and an optimum speed ratio of the reaction stage (low-pressure stage 50*c*) is less than 1.5 and equal to or more than 1.2. In addition, as shown in FIG. 6, the speed ratio is a ratio (c/u) of an absolute speed c of the steam in the outlet of the stator blade configuring a stage with respect to a peripheral speed u of the rotor blade 32 configuring the stage. In addition, the optimum speed ratio means a speed ratio at which the turbine efficiency becomes maximum.

Here, in the present embodiment, in a case where the optimum speed ratio of the medium reaction degree impulse stage is set to be smaller than the optimum speed ratio of the impulse stage and to be greater than the optimum speed ratio of the reaction stage, the optimum speed ratio of each stage is required to be set as follows. For example, in a case where the optimum speed ratio of the impulse stage (speed-adjusting stage 50*a*) is set to 1.8, the optimum, speed, ratio of the medium reaction degree impulse stage (medium-pressure stage 50*b*) is set to be less than 1.8. However, in the present embodiment, the optimum speed ratio of the medium reaction degree impulse stage may not be smaller than the optimum speed ratio of the impulse stage, and the optimum speed ratio of the medium reaction degree impulse stage may not be greater than the optimum speed ratio of the reaction stage.

In the present embodiment, a deflection angle of the rotor blade 32 configuring the impulse stage (speed-adjusting stage 50*a*) is set to be less than 140° and equal to or more than 120°, a deflection angle of the rotor blade 32 configuring the medium reaction degree impulse stage (medium-pressure stage 50*b*) is set to be less than 120° and equal to or more than 110°, and a deflection angle of the rotor blade 32 configuring the reaction stage (low-pressure stage 50*c*) is set to be less than 110° and equal to or more than 70°. In addition, as shown in FIG. 6, the deflection angle is an angle ($\alpha 1+\alpha 2$) defined by an inflow angle $\alpha 1$ of the steam with respect to the rotor blade 32 and an outflow angle $\alpha 2$ of the steam from the rotor blade 32.

Here, in the present embodiment, in a case where the deflection angle of the rotor blade 32 configuring the medium reaction degree impulse stage is set to be smaller than the deflection angle of the rotor blade 32 configuring the impulse stage and to be greater than the deflection angle of the rotor blade 32 configuring the reaction stage, the deflection angle of the rotor blade 32 configuring each stage is required to be set as follows. For example, in a case where the deflection angle of the rotor blade 32 configuring the medium reaction degree impulse stage is set to 100°, the deflection angle of the rotor blade 32 configuring the reaction stage is set to be less than 100° and equal to or more than 70°. Moreover, in the present embodiment, for example, in a case where the deflection angle of the rotor blade 32 configuring the reaction stage is set to 110°, the deflection angle of the rotor blade 32 configuring the medium reaction degree impulse stage is set to be greater than 110° and less than 120°. However, in the present embodiment, the deflection angle of the rotor blade 32 configuring the medium reaction degree impulse stage may not be smaller than the deflection angle of the rotor blade 32 configuring the impulse stage, and the deflection angle of the rotor blade 32 configuring the medium reaction degree impulse stage may not be greater than the deflection angle of the rotor blade 32 configuring the reaction stage.

In the present embodiment, the deflection angle of the stator blade 42 configuring the impulse stage (speed-adjusting stage 50*a*) is set to be equal to or less than 80° and equal to or more than 70°, the deflection angle of the stator blade 42 configuring the medium reaction degree impulse stage (medium-pressure stage 50*b*) is set to be less than 80° and equal to or more than 60°, and the deflection angle of the stator blade 42 configuring the reaction stage (low-pressure stage 50*c*) is set to be less than 70° and equal to or more than 55°.

Here, in the present embodiment, in a case where the deflection angle of the stator blade 42 configuring the medium reaction degree impulse stage is set to be smaller than the deflection angle of the stator blade 42 configuring the impulse stage and to be greater than the deflection angle of the stator blade 42 configuring the reaction stage, the deflection angle of the stator blade 42 configuring each stage is required to be set as follows. For example, in a case where the deflection angle of the stator blade 42 configuring the medium reaction degree impulse stage is set to 60° and the deflection angle of the rotor blade 32 configuring the reaction stage is set to be less than 60° and equal to or more than 55°. However, in the present embodiment, the deflection angle of the stator blade 42 configuring the medium reaction degree impulse stage may not be smaller than the deflection angle of the stator blade 42 configuring the impulse stage, and the deflection angle of the stator blade 42 configuring the medium reaction degree impulse stage may not be greater than the deflection angle of the stator blade 42 configuring the reaction stage.

In the present embodiment, a ratio (Lp/Lc) of a pitch Lp with respect to a cord length Le of the rotor blade 32 configuring the impulse stage (speed-adjusting stage 50*a*) is set to be less than 0.7, the same ratio of the rotor blade 32 configuring the medium reaction degree impulse stage (medium-pressure stage 50*b*) is set to be equal to or more than 0.7 and less than 0.8, and the same ratio of the rotor blade 32 configuring the reaction stage (low-pressure stage 50*c*) is set to be greater than 0.7 and equal to or less than 0.9.

Here, in the present embodiment, in a case where the same ratio of the rotor blade 32 configuring the medium reaction degree impulse stage is set to be greater than the same ratio of the rotor blade 32 configuring the impulse stage and to be smaller than the same ratio of the rotor blade 32 configuring the reaction stage, the same ratio of the rotor blade 32 configuring each stage is required to be as follows. For example, in a case where the same ratio of the rotor blade 32 configuring the medium reaction degree impulse stage is set to 0.78, the same ratio of the rotor blade 32 configuring the reaction stage is set to be equal to or more than 0.78. However, in the present embodiment, the same ratio of the rotor blade 32 configuring the medium reaction degree impulse stage may not be greater than the same ratio of the rotor blade 32 configuring the impulse stage, and the same ratio of the rotor blade 32 configuring the medium reaction degree impulse stage may not be smaller than the same ratio of the rotor blade 32 configuring the reaction stage.

In the present embodiment, the ratio (Lp/Lc) of the pitch Lp with respect to the cord length Lc of the stator blade 42 configuring the impulse stage (speed-adjusting stage 50*a*) is set to be equal to or more than 0.3 and less than 0.6, the same ratio of the stator blade 42 configuring the medium reaction degree impulse stage (mediums-pressure stage 50*b*) is set to be equal to or more than 0.5 and less than 0.8, and the same ratio of the stator blade 42 configuring the reaction stage (low-pressure stage 50*c*) is set to be equal to or more than 0.6 and less than 0.9.

Here, in the present embodiment, in a case where the same ratio of the stator blade 42 configuring the medium reaction degree impulse stage is set to be greater than the same ratio of the stator blade 43 configuring the impulse stage and to be smaller than the same ratio of the stator blade 42 configuring the reaction stage, the same ratio of the stator blade 43 configuring each stage is required to be set as follows. For example, in a case where the same ratio of the stator blade 42 configuring the medium reaction degree impulse stage is set to 0.8, the same ratio of the stator blade 42 configuring the reaction stage is greater than 0.8 and less than 0.9. However, in the present embodiment, the same ratio of the stator blade 42 configuring the medium reaction degree impulse stage may not be greater than the same ratio of the stator blade 42 configuring the impulse stage, and the same ratio of the stator blade 42 configuring the medium reaction degree impulse stage may not be smaller than the same ratio of the stator blade 42 configuring the reaction stage.

In the present embodiment, as described, a disk-shaped rotor shaft is adopted as the rotor shaft 21. Compared to a drum-type rotor shaft, in the disk-shaped rotor shaft, if is possible to decrease steam leakage. Accordingly, in the present embodiment, the steam leakage is further reduced, and it is possible to increase turbine efficiency. However, as the steam turbine of the present embodiment, in the case where the disk-shaped rotor shaft is adopted in the steam turbine having the medium reaction degree impulse stage or the reaction stage, a thrust force applied to the rotor shaft 21 increases and a size of a thrust bearing increases. This is because in a case where the degree of reaction of a stage increases to a certain extent, the pressure difference between the upstream side Dau and the downstream side Dad of the partition portion to which the rotor blade row of this stage is fixed increases. Meanwhile, compared to the disk-shaped rotor shaft, in the drum-type rotor shaft, it is possible to decrease the thrust force applied to the rotor shaft. Accordingly, in the steam turbine disclosed in PTL 1 in which all stages except for the speed-adjusting stage are set to the reaction stages, the drum-type rotor shaft is adopted.

In the present embodiment, even when the disk-shaped rotor shaft in which a leakage amount of steam decreases is adopted as the rotor shaft 21, in order to decrease the thrust force applied to the rotor shaft 21, the balance hole 24 is formed in ail medium-pressure stage partition portions 23*b*. In this way, if the balance hole 24 is formed in the medium-pressure stage partition portion 23*b*, the pressure difference between the upstream side Dau and the downstream side Dad of the medium-pressure stage partition portion 23*b* decreases. Accordingly, in the rotor shaft 21 of the present embodiment, it is possible to decrease the thrust force applied to the rotor shaft 21.

In addition, in the present embodiment, as described above, the intermediate seal 53 is provided at the position close to the outside in the radial direction Dro than the balance hole 24 between the medium-pressure stage partition portion 23*b* and the inner ring 46 of the medium-pressure stage stator blade row 41*b*. Accordingly, in the present embodiment, it is possible to further decrease steam leakage at the medium-pressure stage 50*b* which is the medium reaction degree impulse stage.

Moreover, the intermediate seal 53 of the present embodiment includes the radial fins 54 and 54*a* in which the tip portions extend in the radial direction Dr and face the intermediate peripheral surface 27 of the medium-pressure stage partition portion 23*b*. In a case where the intermediate seal is an axial fin which extends in the axial direction Da, due to thermal elongation (thermal expansion) of the rotor shaft in the axial direction Da according to the inflow of the steam with respect to the steam turbine, a gap between the tip of the axial fin and the facing surface increases compared to the time of assembly. Accordingly, in the case where the intermediate seal is the axial fin, a leakage amount of the steam due to the thermal elongation according to the inflow of the steam with respect to the steam turbine increases. Meanwhile, in the present embodiment, since the intermediate seal 53 has the radial fins 54 and 54*a*, even when the thermal elongation of the rotor shaft 21 in the axial direction Da is generated according to variation of the inflow amount of the steam with respect to the steam turbine, variation of the gap between the tips of the radial fins 54 and 54*a* and the facing surfaces decreases.

Accordingly, in the present embodiment, since the intermediate seal 53 having the radial fins 54 and 54*a* is provided, it is possible to significantly decrease the steam leakage, at the medium-pressure stage 50*b* which is the medium reaction degree impulse stage.

As described above, in the present embodiment, since the medium-pressure stage 50*b* through which steam having a high pressure passes is set to the medium reaction degree impulse stage, it is possible to decrease the steam leakage at the medium-pressure stage 50*b*. Moreover, in the present embodiment, since the disk-shaped rotor shaft is adopted as the rotor shaft 21 and the intermediate seal 53 having the radial fins 54 and 54*a* is provided between the medium-pressure stage partition portion 23*b* of the rotor shaft 21 and the inner ring 46 of the medium-pressure stage stator blade row 41*b*, it is possible to significantly decrease steam leakage at the medium-pressure stage 50*b*. Accordingly, in the present embodiment, although it is repeatedly described, it is possible to effectively use energy included in a high-pressure steam at the medium-pressure stage 50*b*, and it is possible to increase the turbine efficiency.

In addition, in the above-described embodiment, the medium-pressure stage 50*b* is configured of three stages 50, and the low-pressure stage 50*c* is configured of three stages 50. However, the number of the stages 50 configuring the medium-pressure stage 50*b* and the number of stages configuring the low-pressure stage 50*c* may be two or less or may be four or more. Moreover, the number of the stages 50 configuring the medium-pressure stage 50*b* and the number of the stages 50 configuring the low-pressure stage 50*c* may be different from each other.

INDUSTRIAL APPLICABILITY

According to an aspect of the present invention, it is possible to increase turbine efficiency of the steam turbine.

REFERENCE SIGNS LIST

10: casing, 11: nozzle chamber, 12: steam main flow path chamber, 13: exhaust chamber, 20: rotor, 21: rotor shaft, 22: axial core portion, 23: partition portion, 23*a*: speed-adjusting stage partition portion, 23*b*: medium-pressure stage partition portion, 23*c*: low-pressure stage partition portion, 24: balance hole, 27, 47: intermediate peripheral surface, 31: rotor blade row, 31*a*: speed-adjusting stage rotor blade row, 31*b*: medium-pressure stage rotor blade row, 31*c*: low-pressure stage rotor blade row, 32: rotor blade, 41: stator blade row,

41*a*: speed-adjusting stage stator blade row, 41*b*: medium-pressure stage stator blade row, 41*c*: low-pressure stage stator blade row, 42: stator blade, 43: outer ring, 46: inner ring, 51: inner seal, 52: outer seal, 53: intermediate seal, 54, 54*a*: radial fin

The invention claimed is:

1. A steam turbine, comprising:

a rotor shaft which rotates about an axis line;

a plurality of rotor blade rows which are fixed to an outer periphery of the rotor shaft and are arranged in an axial direction in which the axis line extends; and a stator blade row which is adjacent to an upstream side in the axial direction of the rotor blade row for each of the plurality of rotor blade rows, wherein, among a plurality of stages configured of a set of the rotor blade row and the stator blade row disposed to be adjacent to the upstream side of the rotor blade row, a stage disposed on the most upstream side is a speed-adjusting stage, at least one stage, including a second stage, disposed on a downstream side of the speed-adjusting stage and adjacent to the speed-adjusting stage is a medium-pressure stage, and at least one stage disposed on a downstream side of the medium-pressure stage is a low-pressure stage, wherein the speed-adjusting stage is an impulse stage and configured to adjust a flow rate of the steam fed to the stages on a downstream side of a first stage so as to adjust a rotation speed of a rotor having the rotor shaft, wherein the medium-pressure stage is a medium reaction degree impulse stage in which a degree of reaction is a medium degree of reaction of 25% to 35%, and wherein the low-pressure stage is a reaction stage having a degree of reaction which is higher than the degree of reaction of the medium-pressure stage, wherein the rotor shaft includes a plurality of partition portions which spread in a radial direction based on the axis line and are arranged in the axial direction with a gap therebetween, wherein the rotor blade row of the medium-pressure stage is fixed to an outer peripheral portion of any one partition portion of the plurality of partition portions, wherein a balance hole penetrating in the axial direction is formed in a medium-pressure stage partition portion which is the partition portion to which the rotor blade row of the medium-pressure stage is fixed, wherein the stator blade row includes a plurality of stator blades which are arranged in a circumferential direction about the axis line and an inner ring which is disposed on the inside in a radial direction of the plurality of stator blades with respect to the axis line and to which the plurality of stator blade rows are fixed, wherein the inner ring of the stator blade row configuring the medium-pressure stage faces the medium-pressure stage partition portion with a gap therebetween in the axial direction, wherein the steam turbine further includes a seal which is fixed to the inner ring of the stator blade row configuring the medium-pressure stage and seals a portion between the inner ring and the medium-pressure stage partition portion on a portion positioned further outside in the radial direction with respect to the axis line than the balance hole, wherein in the medium-pressure stage partition portion, an intermediate peripheral surface is formed in the radial direction with respect to the axis line further outside in the radial direction than the balance hole on the inner ring side of the medium-pressure stage partition portion, and wherein the seal includes a radial fin having a tip portion which extends in the radial direction and faces the intermediate peripheral surface of the medium-pressure state partition portion.

2. The steam turbine according to claim 1, wherein the medium-pressure stage is configured to include a plurality of stages, and wherein degrees of reaction of the plurality of stages configuring the medium-pressure stage gradually increase from an upstream stage toward a downstream stage.

3. The steam turbine according to claim 1, wherein deflection angles of a plurality of rotor blades configuring the rotor blade row of the medium-pressure stage are smaller than deflection angles of a plurality of rotor blades configuring the rotor blade row of the speed-adjusting stage and are greater than deflection angles of a plurality of rotor blades configuring the rotor blade row of the low-pressure stage.

4. The steam turbine according to claim 1, wherein deflection angles of a plurality of stator blades configuring the stator blade row of the medium-pressure stage are smaller than deflection angles of a plurality of stator blades configuring the stator blade row of the speed-adjusting stage and are greater than deflection angles of a plurality of stator blades configuring the stator blade row of the low-pressure stage.

5. The steam turbine according to claim 1, wherein a plurality of rotor blades configuring the rotor blade row of the medium-pressure stage are parallel blades.

6. A steam turbine, comprising:

a rotor shaft which rotates about an axis line;

a plurality of rotor blade rows which are fixed to an outer periphery of the rotor shaft and are arranged in an axial direction in which the axis line extends; and a stator blade row which is adjacent to an upstream side in the axial direction of the rotor blade row for each of the plurality of rotor blade rows, wherein, among a plurality of stages configured of a set of the rotor blade row and the stator blade row disposed to be adjacent to the upstream side of the rotor blade row, a stage disposed on the most upstream side is a speed-adjusting stage, at least one stage, including a second stage, disposed on a downstream side of the speed-adjusting stage and adjacent to the speed-adjusting stage is a medium-pressure stage, and at least one stage disposed on a downstream side of the medium-pressure stage is a low-pressure stage, wherein the speed-adjusting stage is an impulse stage and configured to adjust a flow rate of the steam fed to the stages on a downstream side of a first stage so as to adjust a rotation speed of a rotor having the rotor shaft, wherein the medium-pressure stage is a medium reaction degree impulse stage in which a degree of reaction is a medium degree of reaction of 25% to 35%, wherein the low-pressure stage is a reaction stage having a degree of reaction which is higher than the degree of reaction of the medium-pressure stage, wherein a speed ratio is defined as a ratio of an absolute speed of the steam in the outlets of stator blades configuring a stage among the plurality of stages with respect to a peripheral speed of rotor blades configuring the stage, an optimum speed ratio is defined as the speed ratio at which turbine efficiency reaches maximum, and the optimum speed ratio of the medium-pressure stage is smaller than the optimum speed ratio of the speed-adjusting stage and is greater than the optimum speed ratio of the low-pressure stage.

7. A steam turbine, comprising:

a rotor shaft which rotates about an axis line;

a plurality of rotor blade rows which are fixed to an outer periphery of the rotor shaft and are arranged in an axial direction in which the axis line extends; and a stator blade row which is adjacent to an upstream side in the axial direction of the rotor blade row for each of the plurality of rotor blade rows, wherein, among a plurality of stages configured of a set of the rotor blade row and the stator blade row disposed to be adjacent to the upstream side of the rotor blade row, a stage disposed on the most upstream side is a speed-adjusting stage, at least one stage, including a second stage disposed on a downstream side of the seed-adjusting stage and adjacent to the speed-adjusting stage is a medium-pressure stage, and at least one stage disposed on a downstream side of the medium-pressure stage is a low-pressure stage, wherein the speed-adjusting stage is an impulse stage and configured to adjust a flow rate of the steam fid to the stages on a downstream side of a first stage so as to adjust a rotation speed of a rotor having the rotor shaft, wherein the medium-pressure stage is a medium reaction degree impulse stage in which a degree of reaction is a medium degree of reaction of 25% to 35%, wherein the low-pressure stage is a reaction stage having a degree of reaction which is higher than the degree of reaction of the medium-pressure stage, and wherein a ratio of a pitch with respect to a cord length of a plurality of rotor blades configuring the rotor blade row of the medium-pressure stage is greater than a ratio of a pitch with respect to a cord length of the plurality of rotor blades configuring the rotor blade row of the speed-adjusting stage and is smaller than a ratio of a pitch with respect to a cord length of the plurality of rotor blades configuring the rotor blade row of the low-pressure stage.

8. A steam turbine, comprising:

a rotor shaft which rotates about an axis line;

a plurality of rotor blade rows which are fixed to an outer periphery of the rotor shaft and are arranged in an axial direction in which the axis line extends, and a stator blade row which is adjacent to an upstream side in the axial direction of the rotor blade row for each of the plurality of rotor blade rows, wherein, among a plurality of stages configured of a set of the rotor blade row and the stator blade row disposed to be adjacent to the upstream side of the rotor blade row, a stage disposed on the most upstream side is a speed-adjusting stage, at least one stage including a second stage, disposed on a downstream side of the speed-adjusting stage and adjacent to the speed-adjusting stage is a medium-pressure stage and at least one stage disposed on a downstream side of the medium-pressure stage is a low-pressure stage, wherein the speed-adjusting stage is an impulse stage and configured to adjust a flow rate of the steam fed to the states on a downstream side of a first stage so as to adjust a rotation speed of a rotor having the rotor shaft, wherein the medium-pressure stage is a medium reaction degree impulse stage in which a degree of reaction is a medium degree of reaction of 25% to 35%, wherein the low-pressure stage is a reaction stage having a degree of reaction which is higher than the degree of reaction of the medium-pressure stage, and wherein a ratio of a pitch with respect to a cord length of a plurality of stator blades configuring the stator blade row of the medium-pressure stage is greater than a ratio of a pitch with respect to a cord length of the plurality of stator blades configuring the stator blade row of the speed-adjusting stage and is smaller than a ratio of a pitch with respect to a cord length of the plurality of stator blades configuring the stator blade row of the low-pressure stage.

* * * * *